US007726894B2

(12) United States Patent
Yoon

(10) Patent No.: US 7,726,894 B2
(45) Date of Patent: Jun. 1, 2010

(54) SCREW-TYPE WRITING INSTRUMENT HAVING EXPANSION AND CONTRACTION FUNCTION

(75) Inventor: Hyun-son Yoon, Seoul (KR)

(73) Assignee: Morris Corporation, Seoul (KR)

( * ) Notice: Subject to any disclaimer, the term of this patent is extended or adjusted under 35 U.S.C. 154(b) by 320 days.

(21) Appl. No.: 11/814,165

(22) PCT Filed: Dec. 16, 2005

(86) PCT No.: PCT/KR2005/004358

§ 371 (c)(1),
(2), (4) Date: Jul. 17, 2007

(87) PCT Pub. No.: WO2006/075846

PCT Pub. Date: Jul. 20, 2006

(65) Prior Publication Data

US 2008/0131189 A1 Jun. 5, 2008

(30) Foreign Application Priority Data

Jan. 17, 2005 (KR) ..... 10-2005-0004048

(51) Int. Cl.
*B43K 5/16* (2006.01)
*B43K 24/02* (2006.01)

(52) U.S. Cl. ..... 401/116; 401/99; 15/184

(58) Field of Classification Search ..... 401/116, 401/99, 107, 108, 115, 68, 71, 75, 17, 117; 15/184

See application file for complete search history.

(56) References Cited

U.S. PATENT DOCUMENTS

| | | | | |
|---|---|---|---|---|
| 3,597,100 | A * | 8/1971 | Ganz | 401/116 |
| 6,273,627 | B1 * | 8/2001 | Mittersinker et al. | 401/99 |
| 6,497,524 | B1 * | 12/2002 | Kim | 401/116 |
| 6,764,239 | B2 * | 7/2004 | Kim | 401/116 |
| 6,942,411 | B2 * | 9/2005 | Kato | 401/116 |

OTHER PUBLICATIONS

WIPO, International Search Report for PCT/KR2005/004358.

* cited by examiner

*Primary Examiner*—David J. Walczak
*Assistant Examiner*—Keegan Gumbs
(74) *Attorney, Agent, or Firm*—Intellectual Property Law Group LLP; Juneko Jackson; Otto O. Lee

(57) ABSTRACT

The present invention provides a screw-type writing instrument having an expansion and contraction function in which an outer shaft cam, a cartridge holder and an inner shaft cam are coupled in a double screw manner, so that the expansion or contraction of the writing instrument and the advancing or retracting operation of a pen core can be simultaneously conducted, thus being convenient to use, and which, thanks to the contractible structure, is convenient to carry and hold.

4 Claims, 9 Drawing Sheets

SCREW-TYPE WRITING INSTRUMENT HAVING EXPANSION AND CONTRACTION FUNCTION

CROSS-REFERENCE TO RELATED APPLICATIONS

This application is a U.S. National Phase application, under 35 U.S.C. §371, of International Application PCT/KR2005/004358, with an international filing date of Dec. 16, 2005 and claims priority to Korean application no. 10-2005-0004048 filed Jan. 17, 2005; all of which are hereby incorporated by reference.

BACKGROUND OF INVENTION

1. Field of Invention

The present invention relates, in general, to retractable writing instruments and, more particularly, to a screw-type writing instrument having an expansion and contraction function which is portable and serves as a fashion accessory.

2. Background

Generally, a retractable writing instrument has a pen core advancing and retracting mechanism such that the tip of the pen core, which is provided in the casing of the writing instrument, can be advanced when one desires to write something, and can be retracted when not in use. This mechanism may be applied to a ballpoint pen, a mechanical pencil, a multi pen, etc.

In the case of a writing instrument having no pen core advancing and retracting mechanism, because the writing instrument can have a small size thanks to the reduced axial length thereof, it may be used as a decorative article, a character product or a fashion accessory as well as having its inherent function as a writing instrument. However, the writing instrument having no pen core advancing and retracting mechanism requires a separate covering means, such as a lid, which eliminates a safety hazard, protects the pen tip, and prevents cloth from becoming stained with ink. This writing instrument is inconvenient because a user must open the separate lid every time he/she desires to use it. Furthermore, there is a disadvantage in that the lifetime of the writing instrument is reduced if the lid is lost.

Meanwhile, in the case of a writing instrument having a pen core advancing and retracting mechanism, because the length of the pen core advancing and retracting mechanism is added to the length of the pen core, the overall length of the writing instrument is longer than that of the writing instrument having no pen core advancing and retracting mechanism. Therefore, in this case, the writing instrument is not suitable for use as a decorative article or a character product and is relatively inconvenient to hold and carry.

In an effort to overcome the above-mentioned problems, a pen tip advancing and retracting device of a writing instrument having an expansion and contraction function was proposed in Korean Utility Model Registration No. 0038481, which was filed in 1988. In this technique, a main body and a cap body are coupled to each other and expand and contract in length. A member, which is integrated with a protective tube coupled to an ink tube, is mounted to the upper end of the main body. A longitudinal hole is formed at a predetermined position in the member, so that the upper end of a pin having a predetermined length is inserted into the longitudinal hole of the member. Here, a protrusion is provided at a predetermined position on the pin, and the pin further extends a length from the protrusion sufficient for the pin to be inserted upwards into the longitudinal hole. Furthermore, one end of the pin is enlarged in diameter. A bushing having a flange is inserted into the lower end of the protecting tube, and a typical coil spring and a conical cap are provided outside the bushing and are screwed to the outer surface of the lower end of the main body. Then, the flange, to which the elasticity of the coil spring is applied, is brought into contact with the lower end of the pin. Meanwhile, a head member is fastened to the cap body such that the upper end of the pin is in close contact with the bottom of the head member.

However, in the conventional pen tip advancing and retracting device of the writing instrument, a large number of elements is required to achieve the purpose of the conventional technique, that is, 1) the main body, 2) the cap body, 3) the ink tube, 4) the protecting tube, 5) the member, 6) the pin, 7) the bushing, 8) the coil spring, 9) the conical cap and 10) the head member. Therefore, the conventional technique has disadvantages of reduced productivity and manufacturability.

Furthermore, the conventional pen tip advancing and retracting device of the writing instrument has a mechanism in which a pen tip is advanced by contacting the bottom of the head member with the upper end of the pin, and is retracted by the elasticity of the coil spring in a second stage after the expansion or contraction process has been conducted. As such, because the pen tip is not advanced or retracted at the moment that the writing instrument is expanded or contracted, there is a disadvantage in that the pen tip is not rapidly advanced or retracted.

As well, in the conventional pen tip advancing and retracting device of the writing instrument, because the main body, having a relatively small diameter, is inserted into the cap body, having a relatively large diameter, the balance and harmony, which are related to aesthetic principles of form, are deteriorated, thus reducing the aesthetic value.

Moreover, the conventional pen tip advancing and retracting device of the writing instrument is inconvenient because the operation of expanding or contracting the main body and the cap body is independent from the operation of advancing or retracting the pen tip.

SUMMARY OF THE INVENTION

Technical Problem

Accordingly, the present invention has been made keeping in mind the above problems occurring in the prior art, and an object of the present invention is to provide a screw-type writing instrument having an expansion and contraction function in which a pen core can be advanced or retracted the moment an outer shaft cam and an outer casing are expanded or contracted, thus being more convenient for the user.

Another object of the present invention is to provide a screw-type writing instrument having the expansion and contraction function in which the outer shaft cam, a cartridge holder and an inner shaft cam are coupled in a double screw manner, so that the expansion or contraction of the writing instrument and the advancing or retracting operation of the pen core can be simultaneously conducted, thus being convenient to use, and which, thanks to the contractible structure, is convenient to carry and hold.

A further object of the present invention is to provide a screw-type writing instrument having the expansion and contraction function having a minimum number of parts, thus maximizing the manufacturability and manufacturing efficiency, thereby increasing industrial applicability, and which protects the pen core, which is advanced or retracted at the same time that the expansion or contraction of the writing instrument is conducted, against outside force, thus ensuring the intended lifetime of the writing instrument until the ink contained in the pen core has been completely consumed.

Yet another object of the present invention is to provide a screw-type writing instrument having the expansion and contraction function which has a streamlined body having therein a mounting hole, through which a mobile phone string may be coupled to the writing instrument, and which provides a good feel when held and appeals to the aesthetic sense of consumers, thus increasing demand therefor, and which may be used as a decorative article, a character product or a fashion accessory as well as having its inherent function as a writing instrument.

Technical Solution

In order to accomplish the above objects, the present invention provides a screw-type writing instrument having an expansion and contraction function with a retractable pen core, comprising: an outer shaft cam, with a first screw groove formed in a circumferential inner surface of the outer shaft cam; a cartridge holder having at a first side thereof a first screw, screwed into the first screw groove, and having at a second side thereof a second screw; an inner shaft cam, with a second screw groove formed in a circumferential inner surface of the inner shaft cam, so that, when the cartridge holder is coaxially inserted into the inner shaft cam, the second screw is screwed into the second screw groove; and an outer casing, including a head part having a seating hole therein, so that a mounting part of the inner shaft cam is coaxially inserted into the seating hole, and a plurality of blades each extending a predetermined length from an end of the head part. The outer shaft cam and the outer casing are coupled to each other, such that, when an axial length of the writing instrument is expanded or contracted by linear movement of the outer shaft cam and the outer casing with respect to each other, a tip of the pen core coupled to the cartridge holder is advanced from or retracted into a tip hole of the outer shaft cam.

According to the present invention, preferably, for engagement of the outer shaft cam with the blades, first two opposite surfaces of the outer shaft cam protrude relatively outwards, while second two opposite surfaces thereof are bulged in a shape having a circumferential outer surface corresponding to a circular inner diameter, so that the blades of the outer casing slidably engage with the second two opposite surfaces.

Furthermore, a layout of the outer shaft cam and the outer casing, which are assembled with each other, may have a streamlined body shape, a diameter of which is reduced from a medial portion thereof to opposite ends thereof, and which has a bulged surface, angled corners and a hollow cross-section having one shape selected from a square shape, a circular shape, a rectangular shape, a triangular shape and a hexagonal shape.

As well, the screw-type writing instrument may further comprise at least one stop protrusion provided on an outer surface of the outer shaft cam, so that the stop protrusion is slidably inserted into guide grooves formed in inner surfaces of the blades of the outer casing.

In addition, the screw-type writing instrument may further comprise: a bottom dead center stopper and a top dead center stopper which are provided at predetermined positions on each of the guide grooves, such that the stop protrusion is hooked to one stopper to maintain a position thereof when the outer shaft cam and the outer casing are expanded or contracted by a second stroke distance.

Preferably, the screw-type writing instrument may further comprise a double screw-type expansible and retractable mechanism, in which, when the outer shaft cam and the outer casing are coupled to each other, the first screw and the second screw are respectively coupled to the first screw groove and the second screw groove in a double screw pair coupling manner, so that the tip of the pen core is advanced from or retracted into the tip hole depending on expansion or contraction of the inner shaft cam and the outer casing.

Furthermore, the first screw may have a relatively short pitch and the second screw may have a relatively long pitch, such that, when the cartridge holder is rotated a predetermined number of revolutions, the first screw moves a shorter stroke distance while the second screw moves a longer stroke distance corresponding to an expansion or contraction distance of the outer shaft cam and the outer casing.

As well, the inner shaft cam and the outer casing may be coupled to each other in a separable type coupling manner or an integral type coupling manner depending on whether the mounting part and the head part are integrated with each other.

The screw-type writing instrument may further comprise: a plurality of rotation prevention stoppers provided on the mounting part, so that the rotation prevention stoppers are inserted into respective stop grooves of the seating hole of the head part.

Furthermore, the outer casing may have a coupling hole in the head part thereof, so that holding means is coupled to the outer casing through the coupling hole.

ADVANTAGEOUS EFFECTS

As described above, the screw-type writing instrument of the present invention has a double screw-type expansible and retractable mechanism such that the expansion or contraction of the axial length thereof and the advance or retraction of a pen core can be simultaneously conducted, so that the present invention can provide a writing instrument having a compact size and a streamlined design, thus appealing to the aesthetic sense of consumers, thereby increasing demand therefor. Furthermore, the present invention may serve as a decorative article, a character product or a fashion accessory as well as having its inherent function as a writing instrument.

Furthermore, the screw-type writing instrument of the present invention comprises an outer shaft cam, the pen core, a cartridge holder, an inner shaft cam and the outer casing. As such, thanks to the reduced number of parts, the present invention has advantages in that the productivity and manufacturability are markedly enhanced, and the probability of malfunction is reduced.

As well, because the screw-type writing instrument of the present invention has a structure in which blades of the outer casing engage with opposite depressed surfaces of the outer shaft cam, the feeling of balance is ensured.

In addition, the screw-type writing instrument of the present invention has a streamlined body, which has therein a mounting hole, through which a mobile phone string or a holding ring may be coupled to the writing instrument, and which has a shape in which a medial portion thereof gradually bulges throughout the entire perimeter to an extent that is appropriate to the extent of reduction in diameter from the medial portion to the opposite ends, thus providing a superior feeling when held, and being convenient to carry and hold.

Although the preferred embodiment of the screw-type writing instrument having the expansion and contraction function according to the present invention has been disclosed with reference to the attached drawings for illustrative purpose, the present invention is not limited to this. Furthermore, those skilled in the art will appreciate that various modifications, additions and substitutions are possible, without departing from the scope and spirit of the invention.

DETAILED DESCRIPTION OF SPECIFIC EMBODIMENTS

Hereinafter, a preferred embodiment of the present invention will be described in detail with reference to the attached drawings.

Figure 1:
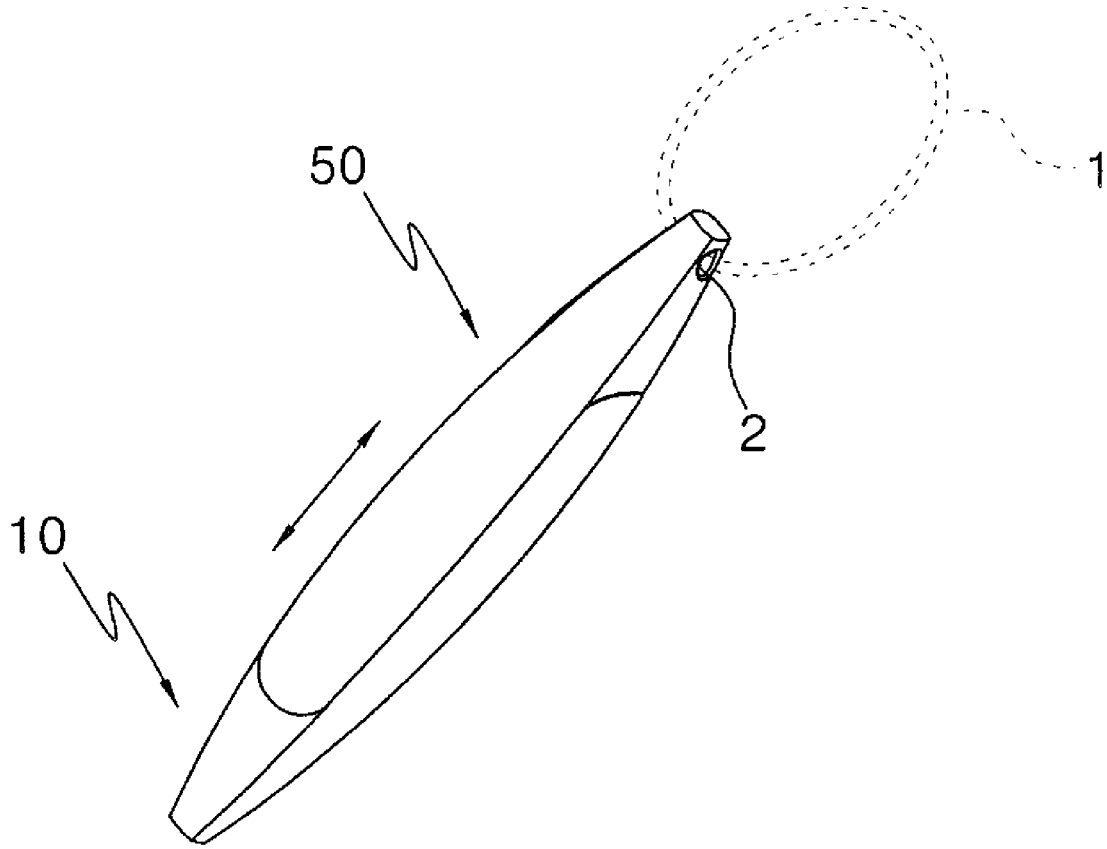
FIG. 1 is a perspective view showing the external shape of a screw-type writing instrument having an expansion and contraction function, according to an embodiment of the present invention.
Figure 2:
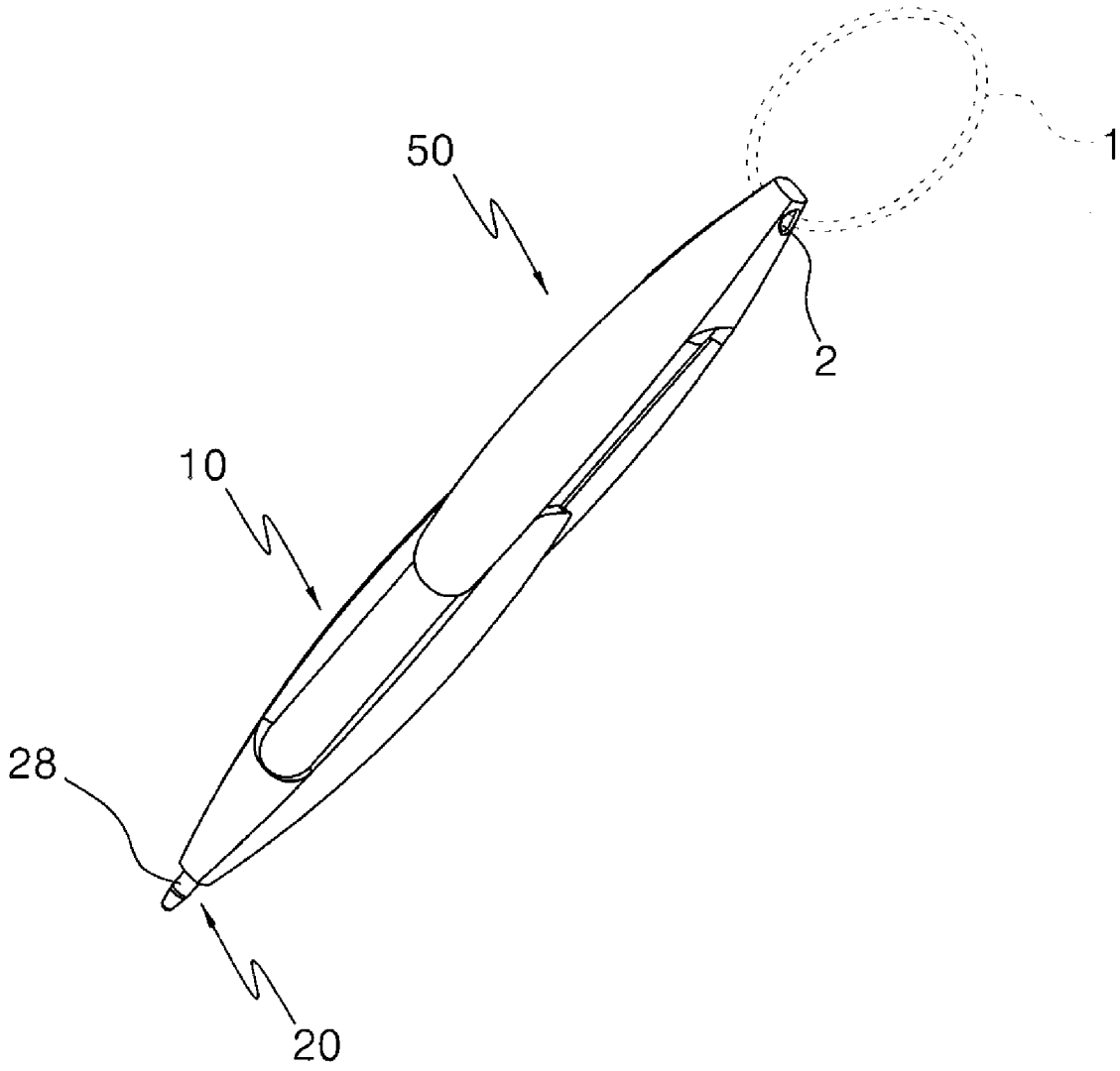
FIG. 2 is a perspective view showing the external shape of the screw-type writing instrument of FIG. 1 in a state of being advanced.
Figure 3:
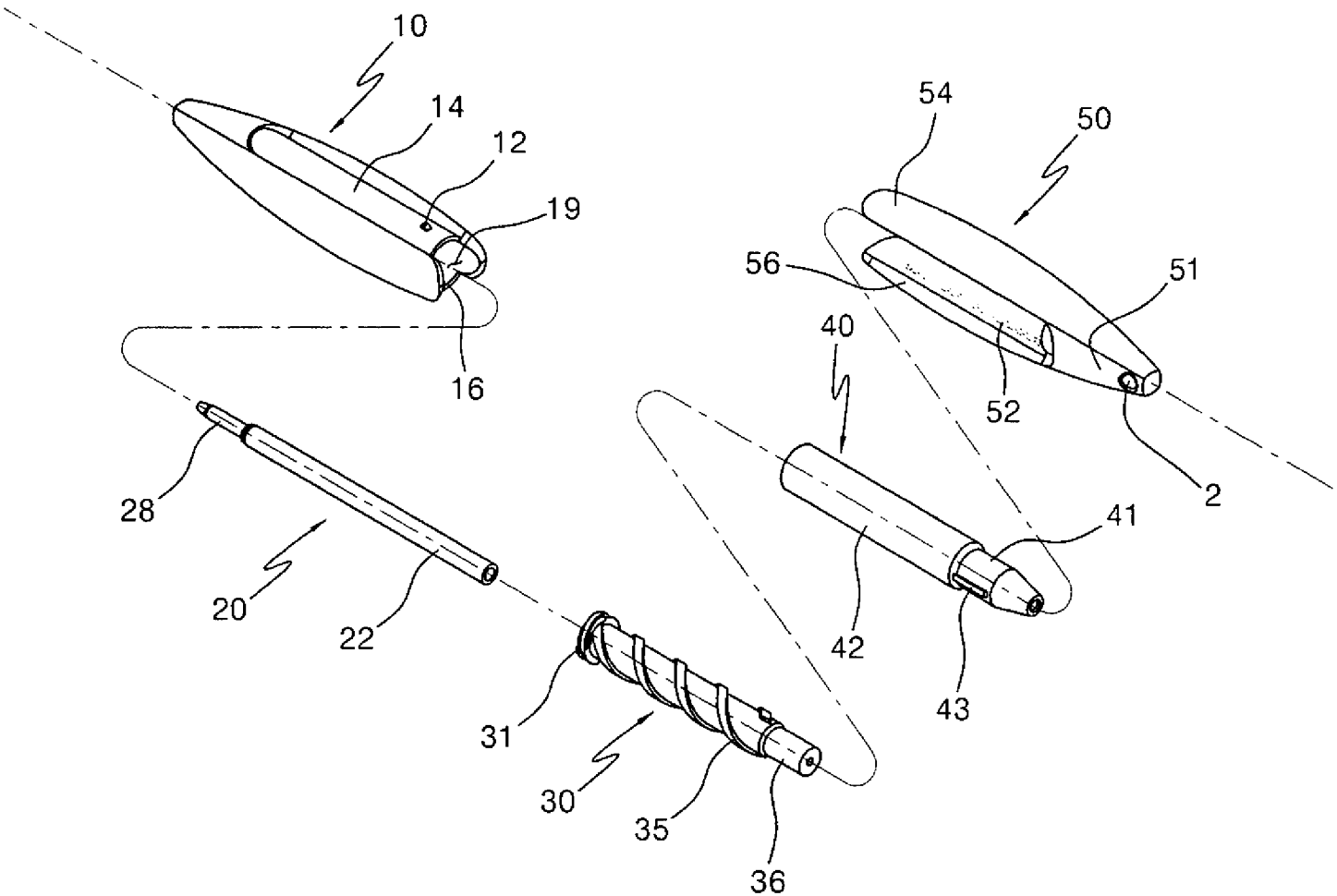
FIG. 3 is an exploded perspective view of the screw-type writing instrument of FIG. 1.
Figure 4:
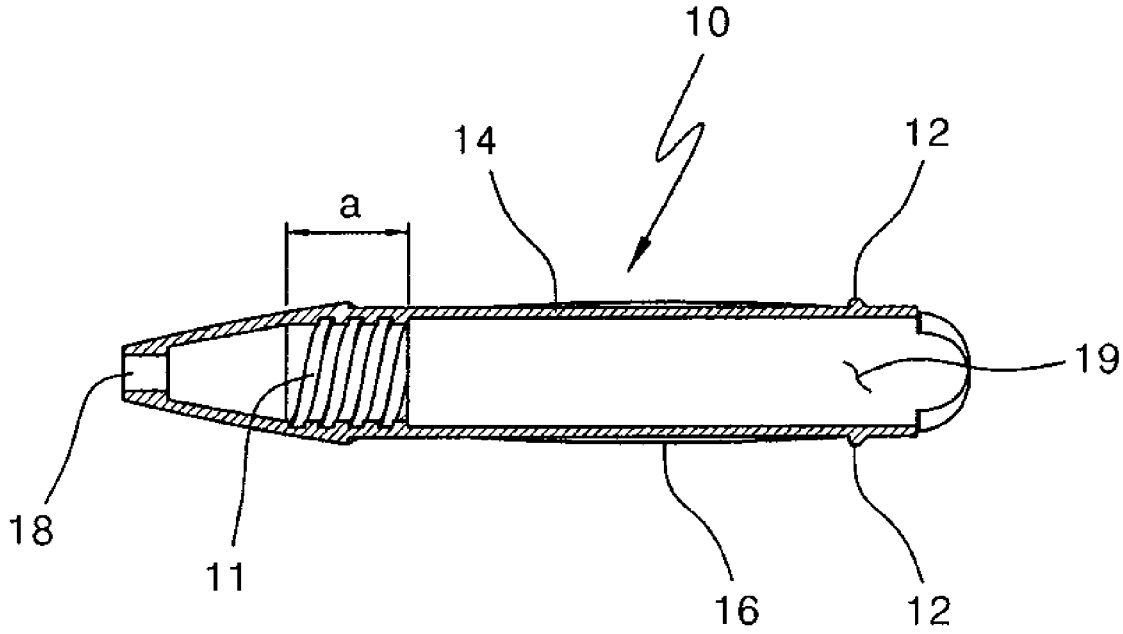
FIG. 4 is a sectional view of an outer shaft cam shown in FIG. 3.
Figure 5:
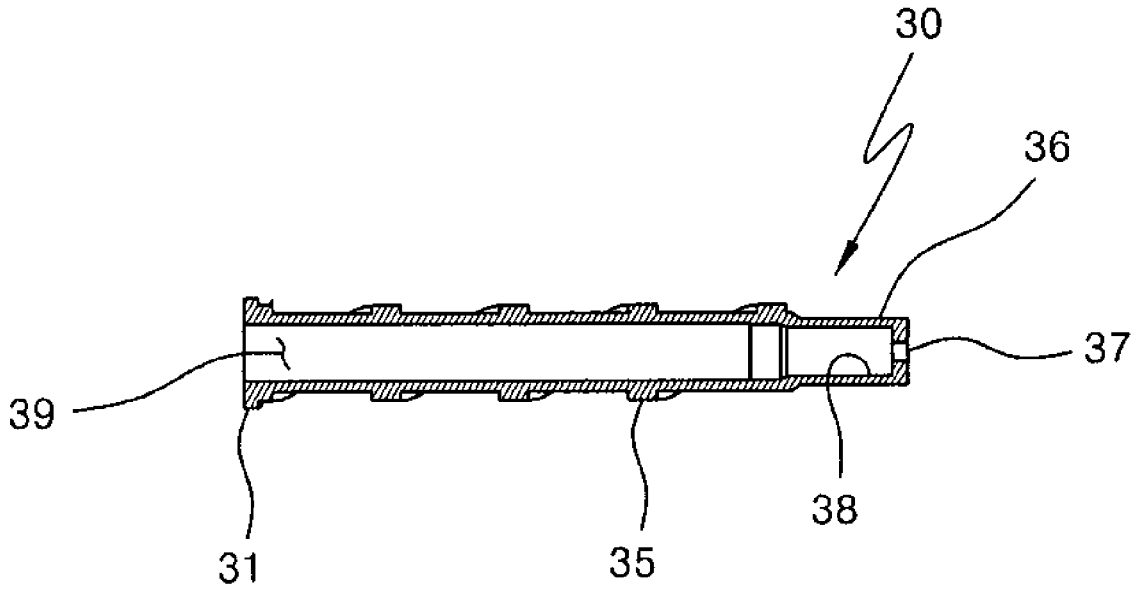
FIG. 5 is a sectional view of a cartridge holder shown in FIG. 3.
Figure 6:
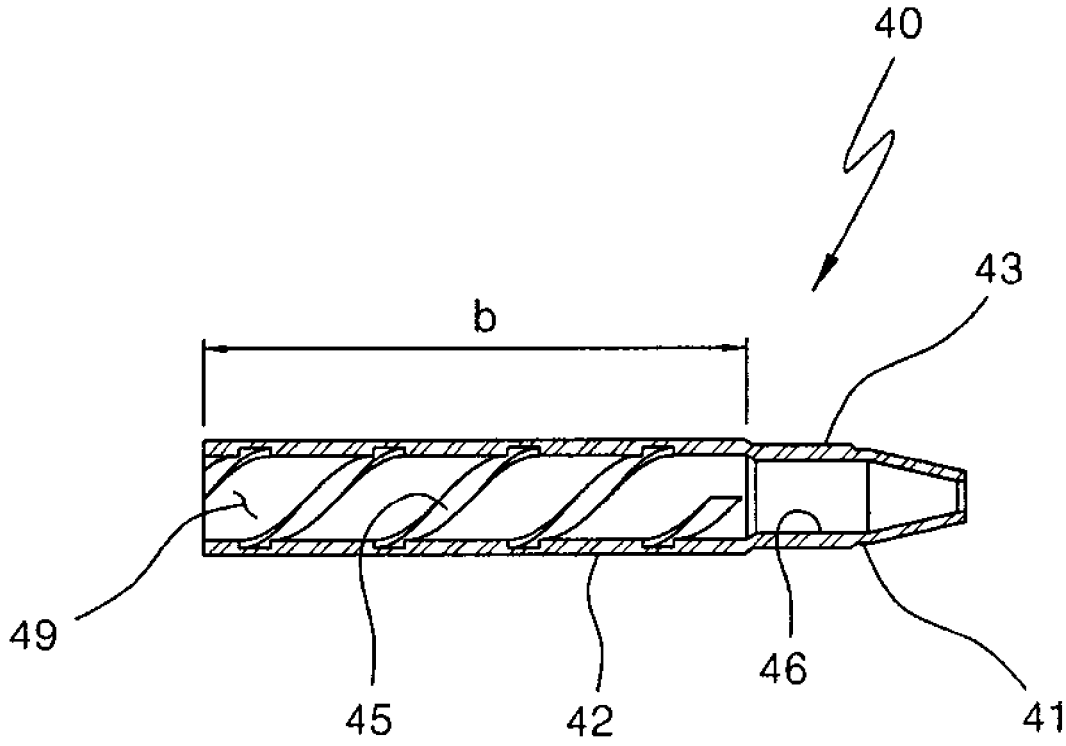
FIG. 6 is a sectional view of an inner shaft cam shown in FIG. 3.
Figure 7:
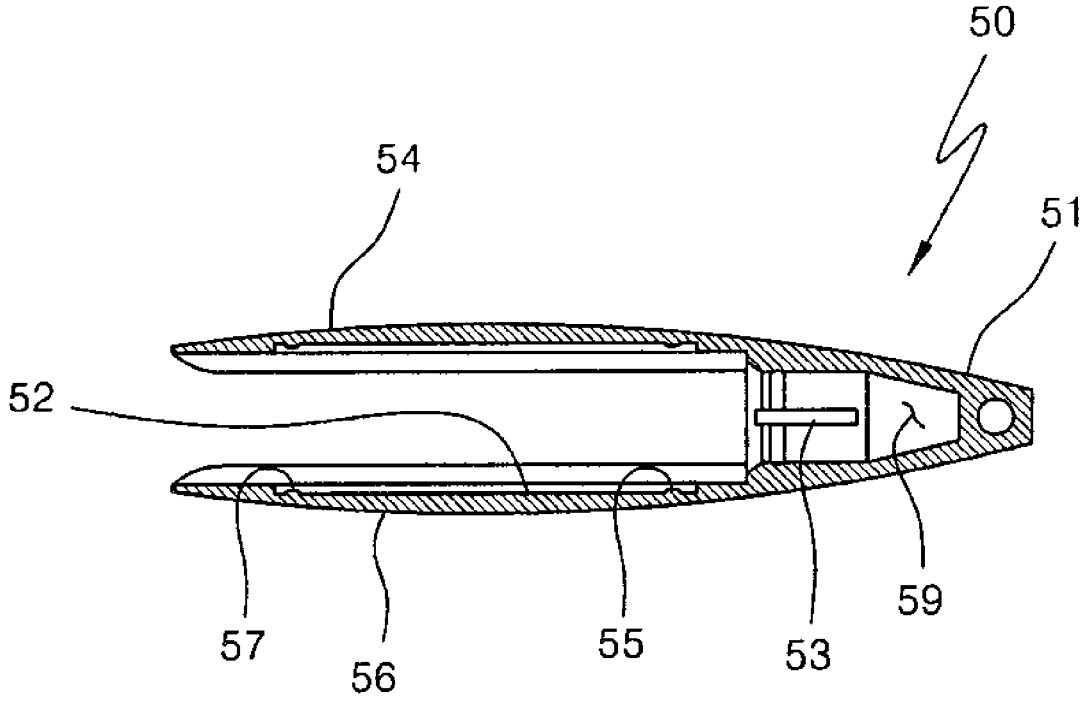
FIG. 7 is a sectional view of an outer casing shown in FIG. 3.
Figure 8:
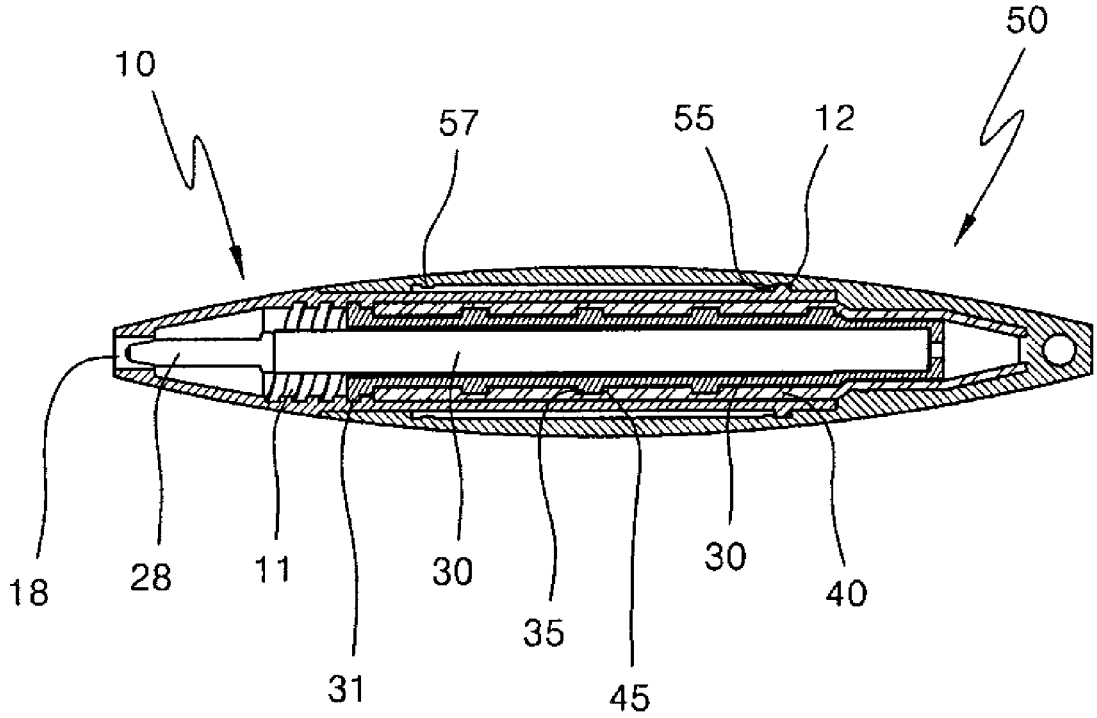
FIGS. 8 and 9 are sectional views illustrating the operation of the screw-type writing instrument of FIG. 1.
Figure 9:
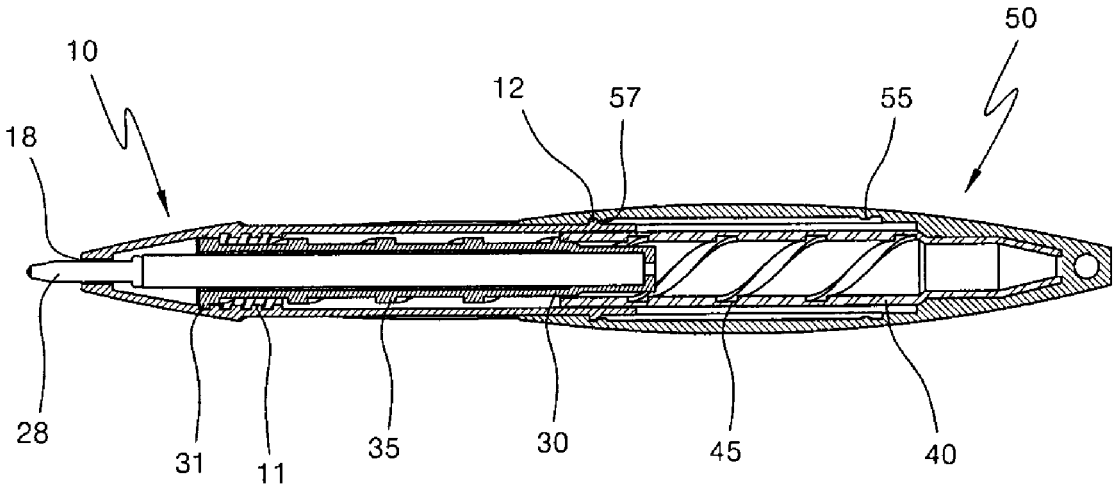

FIG. 1 is a perspective view showing the external shape of a screw-type writing instrument having an expansion and contraction function, according to the preferred embodiment of the present invention. FIG. 2 is a perspective view showing the external shape of the screw-type writing instrument of FIG. 1 in a state of being advanced. FIG. 3 is an exploded perspective view of the screw-type writing instrument of FIG. 1. FIG. 4 is a sectional view of an outer shaft cam shown in FIG. 3. FIG. 5 is a sectional view of a cartridge holder shown in FIG. 3. FIG. 6 is a sectional view of an inner shaft cam shown in FIG. 3. FIG. 7 is a sectional view of an outer casing shown in FIG. 3. FIGS. 8 and 9 are sectional views illustrating the operation of the screw-type writing instrument of FIG. 1.

As shown in FIG. 1, the screw-type writing instrument of the present invention has a streamlined body which includes the outer casing 50, with a coupling hole 2 formed in a head part of the outer casing 50 so that a holding means 1, such as a mobile phone string or a ring, is coupled to the outer casing through the coupling hole 2. For example, the screw-type writing instrument of the present invention has a shape in which a medial portion thereof gradually bulges throughout the entire perimeter to an extent that is appropriate to the extent of reduction in diameter from the medial portion to the opposite ends. Thanks to this shape, when a user pulls the writing instrument using his/her fingers in a longitudinal direction to extend the axial length thereof, or when the user pushes it in the opposite direction to reduce the axial length thereof, appropriate friction between the fingers and the writing instrument is ensured, so that force required for extension or contraction of the writing instrument is easily transmitted from the user's fingers to the writing instrument even without a separate support protrusion. Furthermore, the above-mentioned shape has the advantage of having a simple design.

As such, the screw-type writing instrument of the present invention has a rounded rectangular shape and a high-tech design that appeals to the aesthetic sense of consumers, thus increasing demand therefor. Particularly, when it is in a state of being contracted, it makes an impression of compactness and simplicity on consumers.

Meanwhile, the screw-type writing instrument of the present invention consists of about four to five parts including a retractable pen core which contains ink therein. Here, because the outer casing 50 is either integrally or separately provided with the inner shaft cam, as required, the number of parts of the writing instrument is variable from four to five parts. If the outer casing 50 and the inner cam are manufactured in an integral structure, the manufacturing costs thereof increases and it may be difficult to adapt it to mass production. However, these problems will be solved by developments in injection molding techniques.

Despite the writing instrument having a relatively small number of parts, the present invention realizes a double screw-type expansible and retractable mechanism such that the expansion or contraction of the body and the advance or retraction of the pen core can be simultaneously conducted.

In view of the function, when the writing instrument is extended by pulling the hollow conical outer shaft cam 10 and the outer casing 50 towards opposite ends of the writing instrument, that is, in directions away from each other, the tip 28 of the pen core 20 is advanced by the double screw-type expansible and retractable mechanism, which is provided in the outer shaft cam 10 and the outer casing 50. Conversely, when compressive force is applied to the outer shaft cam 10 and the outer casing 50 in directions approaching each other, the axial length of the writing instrument is reduced and, simultaneously, the tip 28 is retracted into the outer shaft cam 10.

Here, to prevent the thickness of the writing instrument from being increased by the double screw-type expansible and retractable mechanism provided in the outer shaft cam 10 and the outer casing 50, in the present invention, the external shapes of the outer shaft cam 10 and the outer casing 50, which correspond to each other, have peculiar features.

In detail, the external shape of the outer shaft cam 10 is presented below. The diameter of the outer shaft cam 10 is reduced from the medial portion thereof to the opposite ends thereof. Furthermore, the outer shaft cam 10 has a hollow rectangular cross-section with angled corners and a bulged surface. As well, two opposite surfaces of the outer shaft cam 10 protrude outwards somewhat, while the other two opposite surfaces thereof are depressed. Here, the two opposite depressed surfaces has a circumferential outer surface corresponding to a circular inner surface and serve as guide grooves such that each depressed surface engages with each blade of the outer casing 50 so as to be slidable only in an axial direction.

Meanwhile, in the case of the outer casing 50, portions of two opposite sides of the outer casing 50, other than the head part having the coupling hole 2, are open in a thickness direction such that it has balance, harmony and symmetry with respect to the layout of the outer shaft cam 10. A pair of blades extends predetermined lengths, corresponding to that of the opposite depressed surfaces of the outer shaft cam 10, from the head part towards the outer shaft cam 10. Each blade of the outer casing 50 has a predetermined width and thickness such that it engages with each of the opposite depressed surfaces of the outer shaft cam 10 in a sliding coupling structure.

In other words, the blades of the outer casing 50 engage with the opposite depressed surfaces of the outer shaft cam 10, and the protruding opposite surfaces of the outer shaft cam 10 engage with the open opposite sides of the outer casing 50.

In the layout of the outer shaft cam 10 and the outer casing 50 which are assembled with each other, as shown in FIG. 1 or 2, they preferably have a shape, the diameter of which is reduced from the medial portion to the opposite ends, and which has a bulged surface and a hollow cross-section having angled corners and one shape selected from a square shape, a circular shape, a rectangular shape, a triangular shape and a hexagonal shape.

Hereinafter, the coupling construction of the screw-type writing instrument of the present invention will be described in detail with reference to the exploded view of FIG. 3.

The writing instrument of the present invention includes the outer shaft cam 10, the pen core 20, the cartridge holder 30, the inner shaft cam 40 and the outer casing 50.

The outer shaft cam 10 has an axial hole inside the opposite depressed surfaces 14 and 16, so that the pen core 20, the cartridge holder 30 and the inner cam shaft 40, which will be explained below later, are inserted into the axial hole of the outer shaft cam 10.

As shown in FIG. 4, the outer shaft cam 10 has a shaft shape having the axial hole 19 therein. The outer shaft cam 10 includes a hollow conical part, which has therein a tip hole 18, through which the tip 28 of the pen core 20 is advanced or retracted. The outer shaft cam 10 further includes the opposite depressed surfaces 14 and 16 and the protruding opposite surfaces, which are disposed at positions perpendicular to the opposite depressed surfaces 14 and 16.

Furthermore, a first screw groove 11 is formed in the circumferential inner surface of the outer shaft cam 10 at a position adjacent to the tip hole 18. Here, the first screw groove 11 slidably engages with a first screw 31 which is defined by a spiral protrusion or a protruding part having a plurality of spiral threads, so that, when screwing motion is conducted, the cartridge holder 30 is moved a first stroke distance (a) such that the tip 28 of the pen core 20 is advanced an appropriate length outwards through the tip hole of the outer shaft cam 10. Particularly, the first screw 31, defined by the protruding part having a plurality of spiral threads, provides an increased contact surface area with the first screw groove 11, compared to that of the spiral protrusion, thus ensuring stable screwing motion. Furthermore, preferably, lubricant such as silicone is applied to the first screw 31 and the second screw 35 to ensure smooth screwing motion, and they are made of engineering plastic having superior abrasion and breakage resistance ability.

As well, a stop protrusion 12 is provided on each of the opposite depressed surfaces 14 and 16 of the outer shaft cam at a position adjacent to the opening through which the pen core 20 is inserted. The stop protrusions 12 serve as guides during the extension of the writing instrument and serve as stoppers when the writing instrument is lengthened to its maximum length.

The pen core 20 includes a pole 22, which contains ink therein, and the tip 28, which is provided on an end of the pole 22 and discharges an appropriate amount of ink.

As shown in FIGS. 3 and 5, the pen core 20 is inserted into an insertion hole 39 formed in the cartridge holder 30. In detail, the pen core 20 is forcibly fitted into a mounting seat 38, which is formed in a pen core holding part 36 of the cartridge holder 30.

As such, the cartridge holder 30 serves to hold the pen core 20, which is coaxially inserted into the insertion hole of the cartridge holder 30. To realize the double screw-type expansible and retractable mechanism, the first screw 31 is provided on the circumferential outer surface of the open end of the cartridge holder 30, and the second screw 35 is provided on the circumferential outer surface of the cartridge holder 30 from an end of the first screw 31 to an end of the pen core holding part 36.

The pen core holding part 36 is a hollow cylindrical body and closes an end of the cartridge holder 30, other than a vent hole 37 formed through the pen core holding part 36. The mounting seat 38, having a size appropriate to hold the pen core 20, is formed in the pen core holding part 36. The pen core holding part 36 is rotatably inserted into a rotating hole 46, which is axially formed in a mounting part 41 of the inner shaft cam 40.

When the cartridge holder 30 is rotated, the cartridge holder 30 rotates the first screw 31 and the second screw 35 in a screwing motion manner.

Here, the first screw 31 has a relatively short pitch corresponding to the first screw groove 31, and the second screw 35 has a relatively long pitch corresponding to the second screw groove 45.

The first screw 31 is coupled to the first screw groove 11, which is formed in the circumferential inner surface of the outer shaft cam 10, in a screw pair coupling manner that allow relative screwing motion. The second screw 35 is coupled to the second screw groove 45, which is formed in the circumferential inner surface of the inner shaft cam 40, in a screw pair coupling manner.

Furthermore, the start points of the threads of the first and second screws 31 and 35 must be misaligned with each other such that start points of the screwing motions of the first and second screws 31 and 35 differ from each other. Then, the cartridge holder 30 is prevented from being undesirably removed from the outer shaft cam 10.

As shown in FIGS. 3 and 6, the inner shaft cam 40 has a structure such that the cartridge holder 30, containing the pen core 20 therein, is screwed into the inner shaft cam 40. Furthermore, the inner shaft cam 40 serves to convert the linear motion of expansion or contraction between the outer shaft cam 10 and the outer casing 50 into rotating motion.

The inner shaft cam 40 includes a shaft body 42 having a hollow shaft shape. The second screw groove 45 is formed in the circumferential inner surface of the shaft body 42. Here, the second screw groove 45 is screwed to the second screw 35 and is designed such that, when screwing motion is conducted, the axial length of the screw-type writing instrument is expanded or contracted within a preset second stroke distance (b).

The shaft body 42 is open at a first end thereof to allow screw coupling of the inner shaft cam 40 and is integrally coupled at a second end thereof to the mounting part 41.

Furthermore, a plurality of rotation prevention stoppers 43, each of which extends in an axial direction and protrudes in a radial direction, is provided on the planar circumferential outer surface of the mounting part 41 of the inner shaft cam 40.

Furthermore, the rotating hole 46 is preferably formed in the mounting part 41 of the inner shaft cam 40, so that the pen core holding part 36 of the cartridge holder 30 is inserted into the rotating hole 46.

As well, the second end of the inner shaft cam 40, having a conical shape, is securely fitted into a seating hole 59, which is axially formed in the head part 51 of the outer casing 50.

As shown in FIGS. 3 and 7, the seating hole 59, into which the inner shaft cam 40 is inserted, is formed in the head part 51 of the outer casing 50. A plurality of stop grooves 53, which engage with the rotation prevention stoppers 43 of the inner shaft cam 40, is formed in the seating hole 59.

The outer casing 50 has two streamlined blades 54 and 56, which extend from the head part 51 towards the outer shaft cam 10.

The space defined between the blades 54 and 56, which face each other, must have a predetermined size such that, when the inner shaft cam 40 is axially inserted into the outer casing 50, a gap is defined between the circumferential outer surface of the shaft body 42 of the inner shaft cam 40 and the inner surface of each blade 54, 56.

Here, the gap is limited to the value resulting from adding a predetermined tolerance to the thickness of a part corresponding to each of the opposite depressed surfaces 14 and 16 of the outer shaft cam 10 when the outer shaft cam 10 and the outer casing 50 are coupled to each other.

That is, when the opposite depressed surfaces 14 and 16 of the outer shaft cam 10 is inserted into the gaps of the outer casing 50, the blades 54 and 56 of the outer casing 50 are disposed at positions surrounding the opposite depressed surfaces 14 and 16, and the cartridge holder 30 coupled to the outer casing 50 is inserted into the axial hole of the outer shaft cam 10.

Furthermore, a guide groove 52, which extends a predetermined length corresponding to the preset second stroke distance, is axially formed in the inner surface of each blade 54, 56 at a position corresponding to each stop protrusion 12 of the outer shaft cam 10. Stoppers 55 and 57 are provided at positions adjacent to respective opposite ends of each guide groove 52, such that the stop protrusion 12 of the outer shaft cam 10 is hooked to one stopper 55 or 57 to maintain the position thereof after the outer shaft cam 10 and the outer casing 50 slide a predetermined distance with respect to each other.

In detail, the stoppers 55 and 57 comprise a top dead center stopper 57 and a bottom dead center stopper 55. Preferably, the bottom dead center stopper 55 is disposed at a position at which it contacts the stop protrusion 12 when the writing instrument is contracted by the second stroke length, and the top dead center stopper 57 is disposed at a position at which it contacts the stop protrusion 12 when the outer shaft cam 10 and the outer casing 50 are expanded by the second stroke length.

In a brief description of the assembly of the writing instrument with reference to FIG. 3, a worker inserts the pen core 20 into the cartridge holder 30 such that the tip 28 is oriented outwards, and fastens the inserted end of the pen core 20 to the pen core holding part 36 of the cartridge holder 30.

Thereafter, the worker inserts the cartridge holder 30 into the axial hole 19 of the outer shaft cam 10 and screws the first screw 31 into the first screw groove 11 until the first screw 31 is stopped by the end of the first screw groove 11.

Subsequently, the worker applies an adhesive to the surface of the mounting part 41 of the inner shaft cam 40 and inserts it into the seating hole 59 formed in the head part 51 of the outer casing 50.

In this state, the worker axially engages the blades 54 and 56 of the outer casing 50 with the opposite depressed surfaces 14 and 16 of the outer shaft cam 10. At this time, (1) the stop protrusions 12 of the opposite depressed surfaces 14 and 16 are inserted into the respective guide grooves 52, formed in the inner surfaces of the blades 54 and 56, and are elastically hooked to and stopped by the top dead center stoppers 57, (2) the shaft body 42 of the inner shaft cam 40 is inserted into the axial hole 19 of the outer shaft cam 10, and (3) the second screw 35 of the cartridge holder 30 is screwed to the second screw groove 45 of the inner shaft cam 40.

The screw-type writing instrument of the present invention, assembled through the above-mentioned process, is in an expanded state in FIG. 9.

In this state, to contract the writing instrument, the user holds the outer shaft cam 10 and the outer casing 50 using his/her hands and compresses them in directions approaching each other, or the user holds the outer shaft cam 10 using one hand, places the end of the outer casing 50 in contact with a support surface, and pushes the outer shaft cam 10 towards the support surface.

Then, the opposite depressed surfaces 14 and 16 of the outer shaft cam 10 guide the blades 54 and 56 of the outer casing 50 and, simultaneously, the stop protrusions 12 pass over the top dead center stoppers 57 and are linearly moved along the guide grooves 52 by compressing force in the direction in which the axial length of the writing instrument is contracted.

This linear axial length contraction operation rotates the cartridge holder 40 in one direction through the screw coupling relationship between the second screw 35 and the second screw groove 45.

Furthermore, the rotation of the cartridge holder 40 causes the first screw 31 to undergo screwing movement along the first screw groove 11 of the outer shaft cam 10. As a result, the pen core 20 is moved inwards by the first stroke distance, so that the tip 28 of the pen core 20 is retracted into the outer shaft cam 10, and the writing instrument enters the state of FIG. 8.

Conversely, when the user holds and pulls the outer shaft cam 10 and the outer casing 50 outwards using his/her hands, the linear axial length expansion operation of the writing instrument is conducted.

This linear axial length expansion operation rotates the cartridge holder 40 in the direction opposite to that of the linear axial length contraction operation through the screw coupling relationship between the second screw 35 and the second screw groove 45.

Furthermore, this opposite rotation of the cartridge holder 40 causes the first screw 31 to undergo screwing movement along the first screw groove 11 of the outer shaft cam 10 in the direction opposite to that of the linear axial length contraction operation. As a result, the pen core 20 is moved outwards by the first stroke distance, thereby the tip 28 of the pen core 20 is advanced from the outer shaft cam 10, and the writing instrument again enters the state of FIG. 9.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments of the foregoing description, but rather is indicated by the appended claims. All changes that come within the meaning and range of equivalents within the claims are intended to be considered as being embraced within the spirit and scope of the claims.

I claim:

1. A screw-type writing instrument having an expansion and contraction function with a retractable pen core, comprising:

an outer shaft cam, with a first screw groove formed in a circumferential inner surface of the outer shaft cam;

a cartridge holder having at a first side thereof a first screw, screwed into the first screw groove, and having at a second side thereof a second screw;

an inner shaft cam, with a second screw groove formed in a circumferential inner surface of the inner shaft cam, so that, when the cartridge holder is coaxially inserted into the inner shaft cam, the second screw is screwed into the second screw groove; and an outer casing, comprising: a head part having a seating hole therein, so that a mounting part of the inner shaft cam is coaxially inserted into the seating hole; and a plurality of blades each extending a predetermined length from an end of the head part, wherein the outer shaft cam and the outer casing are coupled to each other, such that, when an axial length of the writing instrument is expanded or contracted by linear movement of the outer shaft cam and the outer casing with respect to each other, a tip of the pen core coupled to the cartridge holder is advanced from or retracted into a tip hole of the outer shaft cam, and wherein, for engagement of the outer shaft cam with the blades, first two opposite surfaces of the outer shaft cam protrude relatively outwards, while second two opposite surfaces thereof are bulged in a shape having a circumferential outer surface corresponding to a circular inner diameter, so that the blades of the outer casing slidably engage with the second two opposite surfaces.

2. A screw-type writing instrument having an expansion and contraction function with a retractable pen core, comprising:

an outer shaft cam, with a first screw groove formed in a circumferential inner surface of the outer shaft cam;

a cartridge holder having at a first side thereof a first screw, screwed into the first screw groove, and having at a second side thereof a second screw;

an inner shaft cam, with a second screw groove formed in a circumferential inner surface of the inner shaft cam, so that, when the cartridge holder is coaxially inserted into the inner shaft cam, the second screw is screwed into the second screw groove;

an outer casing, comprising: a head part having a seating hole therein, so that a mounting part of the inner shaft cam is coaxially inserted into the seating hole; and a plurality of blades each extending a predetermined length from an end of the head part;

at least one stop protrusion provided on an outer surface of the outer shaft cam, so that the stop protrusion is slidably inserted into guide grooves formed in inner surfaces of the blades of the outer casing, wherein the outer shaft cam and the outer casing are coupled to each other, such that, when an axial length of the writing instrument is expanded or contracted by linear movement of the outer shaft cam and the outer casing with respect to each other, a tip of the pen core coupled to the cartridge holder is advanced from or retracted into a tip hole of the outer shaft cam.

3. The screw-type writing instrument having the expansion and contraction function according to claim 2, further comprising:

a bottom dead center stopper and a top dead center stopper provided at predetermined positions on each of the guide grooves, such that the stop protrusion is hooked to one stopper to maintain a position thereof when the outer shaft cam and the outer casing are expanded or contracted by a second stroke distance (b).

4. A screw-type writing instrument having an expansion and contraction function with a retractable pen core, comprising:

an outer shaft cam, with a first screw groove formed in a circumferential inner surface of the outer shaft cam;

a cartridge holder having at a first side thereof a first screw, screwed into the first screw groove, and having at a second side thereof a second screw;

an inner shaft cam, with a second screw groove formed in a circumferential inner surface of the inner shaft cam, so that, when the cartridge holder is coaxially inserted into the inner shaft cam, the second screw is screwed into the second screw groove; and an outer casing, comprising: a head part having a seating hole therein, so that a mounting part of the inner shaft cam is coaxially inserted into the seating hole; and a plurality of blades each extending a predetermined length from an end of the head part, wherein the outer shaft cam and the outer casing are coupled to each other, such that, when an axial length of the writing instrument is expanded or contracted by linear movement of the outer shaft cam and the outer casing with respect to each other, a tip of the pen core coupled to the cartridge holder is advanced from or retracted into a tip hole of the outer shaft cam, and wherein the first screw has a relatively short pitch and the second screw has a relatively long pitch, such that, when the cartridge holder is rotated a predetermined number of revolutions, the first screw moves a shorter stroke distance (a) while the second screw moves a longer stroke distance (b) corresponding to an expansion or contraction distance of the outer shaft cam and the outer casing.

* * * * *